US006486604B1

(12) United States Patent
Bradatsch et al.

(10) Patent No.: US 6,486,604 B1
(45) Date of Patent: Nov. 26, 2002

(54) TRAVELING-WAVE VALVE ARRANGEMENT

(75) Inventors: Hubert Bradatsch, Neu-Ulm (DE); Andreas Peters, Ulm (DE)

(73) Assignee: Thales Electron Devices GmbH, Ulm (DE)

( * ) Notice: Subject to any disclaimer, the term of this patent is extended or adjusted under 35 U.S.C. 154(b) by 0 days.

(21) Appl. No.: 09/509,517

(22) PCT Filed: Jun. 11, 1999

(86) PCT No.: PCT/DE99/01707

§ 371 (c)(1),
(2), (4) Date: Mar. 29, 2000

(87) PCT Pub. No.: WO00/77818

PCT Pub. Date: Dec. 21, 2000

(30) Foreign Application Priority Data

Apr. 23, 1998 (DE) ..... 198 18 144

(51) Int. Cl.[7] ..... H01J 25/34

(52) U.S. Cl. ..... 315/3.5; 313/45; 313/46; 330/43

(58) Field of Search ..... 315/3.5; 313/45, 313/46; 330/43, 149

(56) References Cited

U.S. PATENT DOCUMENTS

| | | | | |
|---|---|---|---|---|
| D201,553 S | * | 7/1965 | Disman et al. | 315/3.5 X |
| 4,701,717 A | * | 10/1987 | Radermacher et al. | 330/149 |
| 5,334,907 A | * | 8/1994 | Desmur et al. | 313/46 X |

FOREIGN PATENT DOCUMENTS

| | | |
|---|---|---|
| DE | 36 36 865 | 12/1987 |
| DE | 41 30 495 | 3/1993 |
| GB | 2 274 542 | 7/1994 |
| JP | 07 226166 | 8/1995 |
| JP | 07 245950 | 9/1995 |

* cited by examiner

*Primary Examiner*—Benny T. Lee
(74) *Attorney, Agent, or Firm*—Collard & Roe, P.C.

(57) ABSTRACT

For a traveling-wave valve arrangement with a traveling-wave valve and a linearizing circuit arrangement, it is proposed to design the linearizing circuit arrangement and the traveling-wave valve as one constructional unit and, for the thermal protection of the linearizing circuit arrangement in the simultaneous presence of a high permissible temperature of the valve housing, to maintain the circuit arrangement by means of an active cooling element at a nondamaging temperature lower than the one of the wall of the valve or of a common wall. The cooling element is preferably a Peltier element.

9 Claims, 1 Drawing Sheet

TRAVELING-WAVE VALVE ARRANGEMENT

CROSS REFERENCE TO RELATED APPLICATIONS

This application claims the benefit of PCT/DE99/01707 filed on Jun. 1, 1999.

FIELD OF THE INVENTION

The invention relates to a traveling-wave valve arrangement with a traveling-wave valve and a linearizing circuit arrangement.

THE PRIOR ART

Traveling-wave valves are preferably employed as high-capacity amplifiers in the microwave range, and in particular in satellites. The power lost in the course of operation of such amplifier valves is dissipated as heat into the environment. When such valves are employed with satellites, the heat is dissipated into space through emission, whereby the housing of the valve is typically secured on the inner side of a heat-conducting wall section of the satellite, and the heat lost is dissipated via the housing of the valve into the wall section and emitted by the wall section. The emitting surface may become smaller as the temperature of the surface increases with no change in the emission power. A permissible minimum temperature of the housing of, for example, 100° C. is therefore frequently required for the valves. The high component of power lost by the valve collector is partially emitted via separate radiators projecting from the satellite housing.

Traveling-wave valves exhibit a distinct phase response within the operating frequency band. For the purpose of compensating such a phase response, it is known to transmit the control signals for the valves via a linearizing circuit arrangement with a complementary phase response. The circuit arrangement is herein briefly referred to as a linearizer. The connection between the signal generator, the linearizer and the signal input of the valve is typically realized via flexible coaxial connections. This protects the circuit arrangement against damage by the high temperatures of the valve in that it is located with a spacing from the valve.

SUMMARY OF THE INVENTION

The present invention is based on the problem of proposing an advantageous traveling-wave valve arrangement with a traveling-wave valve and a linearizing circuit arrangement.

The invention results in a traveling-wave valve arrangement that is available to the user as a linearized traveling-wave valve without the previously required outside wiring while retaining high permissible temperatures of the housing at the same time. The constructional combination reduces the space requirements of the arrangement and avoids the expenditure for connections that is associated with circuit arrangements which otherwise have to be integrated in the feed line. Furthermore, the constructional combination of the linearizer with the traveling-wave valve offers the user substantially simplified handling, and offers the manufacturer the possibility of being able to offer through individual adaptation of the linearizing circuit arrangement to the individual valve a type of valve with guaranteed very good linearity. Influences deteriorating the linearity properties as a result of unfavorable installation measures at the user's facility can be excluded to a large extent.

An important feature of the arrangement as defined by the invention is the use of an active cooling element that keeps the linearizing circuit arrangement, herein also briefly referred to as the linearizer, at a temperature lower than that of the wall of the valve. The active cooling element is characterized in that it dissipates heat from a colder surface into a warmer surface. Because of the mechanical insensitivity of the simple electrical controls and the long useful life, the active cooling element is preferably a Peltier element.

By employing an active cooling element and due to the power lost in the element, the power loss occurring in the valve arrangement that has to be discharged is in fact increased overall. However, the power loss component caused by the cooling element is low as compared to the power loss of the travelingwave valve, on the one hand, and any minor increase that may occur in the temperature of the housing of the valve due to the additional loss component is not critical, on the other hand.

The temperature of the linearizer is limited by the cooling element to a temperature not critical for the structural components of the linearizer, preferably to 60° C. at the most. The cooling element can be employed as an active element with controllable cooling capacity in a temperature control circuit with a temperature sensor for the temperature of the linearizer, whereby the controllability of a Peltier element is again especially advantageous. The linearizing circuit arrangement may be present, for example in the form of a structure on a printed circuit motherboard with a plurality of components, or fully integrated in the form of an individual integrated circuit.

The linearizer is usually arranged in an electromagnetically screened housing in order to avoid interference caused by leakage fields especially of the traveling-wave valve. In the arrangement as defined by the invention, the housing advantageously acts as an additional radiation barrier and heat insulator against the emission of heat from the valve located in the immediate proximity, or from a common housing of the valve arrangement that may enclose also the housing of the linearizer. By designing the inwardly and/or outwardly facing surfaces of the housing for low radiation emission or radiation absorption power for heat radiation, it is possible to further reduce heating of the linearizer via this path of radiation.

The linearizer is mechanically connected with the wall of the valve or with the wall of a common housing of the valve arrangement substantially only via the cooling element, so that no or minimal solid-body heat transfer takes place from the wall to the linearizer. In an advantageous embodiment of the invention, the housing of the linearizer is secured with a surface of the housing on the cooling surface of the cooling element, which therefore serves as the mechanical carrier that is preferably secured with its heat-radiating surface on the valve wall or on a common wall. Also, the heat-emitting surface of the cooling element can be directly joined with a heat-dissipating surface of an object such as an outside wall of a satellite.

In another advantageous embodiment of the invention, the cooling element is arranged, with at least its cooling surface, within the housing of the linearizer, and the cooling element is preferably used directly as the carrier for the linearizing circuit arrangement, in that the linearizer is mechanically secured on the cooling element, as opposed to an arrangement having a common carrier plate. This establishes good thermal contact with the linearizing circuit arrangement. The heat-emitting surface of the cooling element can then be advantageously coupled with a surface of the housing of the linearizer, and the surface can be thermally coupled with a wall of the valve or with a common wall or with a heat-dissipating surface of the object.

The linearizer is advantageously arranged near the radiation generating system and/or the signal input of the valve and far away from the collector of the valve, so that stronger radiation of heat into the linearizer due to the high temperature of the collector, as well as long signal paths from the linearizer to the signal input are avoided.

BRIEF DESCRIPTION OF THE DRAWINGS

The invention is explained in greater detail in the following with the help of preferred exemplified embodiments and by reference to the drawing, in which.

DETAIL DESCRIPTION OF THE INVENTION

Figure 1:
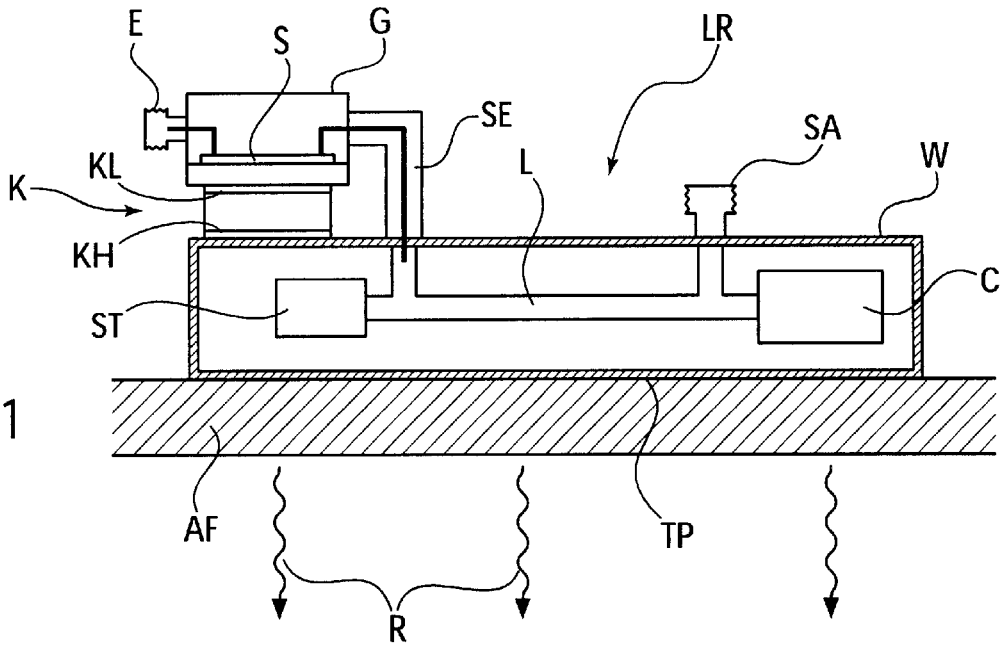
FIG. 1 shows a traveling-wave valve arrangement with a linearizer arranged on the valve housing on the outer side.

In the arrangement sketched in FIG. 1, a commonly used traveling-wave valve LR, which is surrounded by a stable wall, is secured with the surface of a wall on the heat-dissipating outer wall AF of a satellite. The heat emitted by the traveling-wave valve via its housing surface that is in contact with the satellite wall AF, is distributed in the outer wall AF of the satellite through solid-body heat conduction over a larger surface area, and primarily dissipated into outer space through the heat radiation R. The traveling-wave valve is in a typical way structured from a radiation generating system ST, a delay line L, and a collector C, and has a high-frequency signal input E and a signal output SA through the housing wall W. The interior structure of traveling-wave valves is known and of no importance to the invention in detail.

A cooling element K in the form of a Peltier element with a cooling surface KL that is cooler during operation, and with a warmer heat-emitting surface KH, is secured on a part of the surface of the wall W of the traveling-wave valve LR near the radiation generation system ST and the signal input SE. The cooling element can be secured directly by gluing, using an adhesive with good thermal conductivity, or with the help of fastening means not shown in detail. The heat-radiating surface is in good thermal contact with the wall W of the traveling-wave valve.

The housing G of a linearizer is fastened on the cooling surface KL of the cooling element K, whereby the housing is again fastened with good thermal contact between a surface of the housing G and the cooling surface KL, and can be secured via adhesive or with the help of fasteners not shown. The actual linearizer is arranged in the interior of the housing G in the form of a circuit arrangement S present there as a structure on a printed circuit motherboard, or in the form of an individual integrated circuit. The linearizer is screened by the housing G against electromagnetic radiation, in particular against leakage fields of the traveling-wave valve LR. A high-frequency control signal can be supplied to the linearizer via an input connection E. The high-frequency input signal, which is provided with a pre-distorting phase response that is complementary with respect to the phase response of the traveling-wave valve, is supplied to the signal input SE of the valve with a short length of the line leading from the linearizer to the valve. Since cooling of the circuit arrangement S by the cooling surface KL of the cooling element K is of primary importance, the circuit arrangement S is in good thermal contact with the cooled surface of the housing G. The housing G effects at the same time screening of the circuit arrangement S against direct heat radiation into the latter from the wall W of the traveling-wave valve, the wall being heated to a high temperature.

Figure 3:
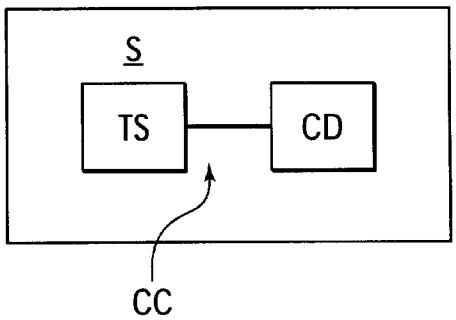
FIG. 3 shows a control circuit for controlling the current through the cooling element.

It is assumed that a temperature value of, for example 100° C. is permissible during operation for the temperature of the wall W of the traveling-wave valve at a reference point TP. The areas of the wall W that are not directly in contact wit the heat-dissipating wall AP of the satellite, may also reach higher temperatures. The cooling element K, which in particular is a Peltier element, transports heat from the circuit arrangement S via a surface of the housing G and the cooling surface KL to the heat-emitting surface KH, which is at a substantially higher temperature, and transfers the heat into the wall w of the traveling-wave valve. It is assumed that the temperature of the circuit arrangement is limited by the cooling element to maximally 60° C. Via a control circuit CC whose components are shown in FIG. 3 and which in particular comprises temperature sensor TS located on or near the circuit arrangement S and a controlling device CD for controlling the current through the cooling element K, it in possible to control the electric power absorbed by the cooling element K for maintaining the circuit arrangement S at a substantially constant temperature.

Figure 2:
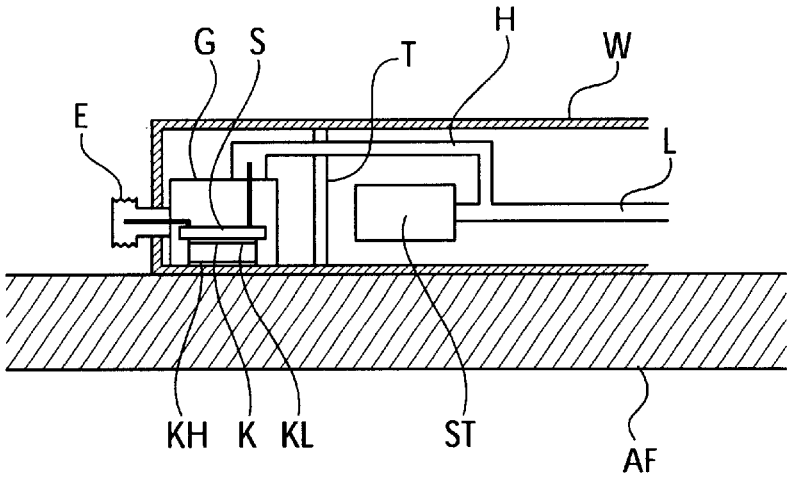
FIG. 2 shows a valve arrangement with a linearizer arranged in a common housing.

The arrangement sketched in FIG. 2 substantially differs from the arrangement according to FIG. 1 in that the linearizer with the completely screened housing G is arranged within a common housing of the traveling-wave valve arrangement, whose wall is again denoted by W. The input connection E leading to the linearizing circuit arrangement extends through the common wall W. The connection between the linearizer and the signal input of the traveling-wave valve is realized within the common wall W, for example through a hollow conductor section H. Within the common wall, the traveling-wave valve and the linearizer are separated from one another preferably by a separation wall T, which reduces leakage fields and blocks off direct heat radiation. The linearizer is located at the end of the traveling-wave valve structure, the end being disposed in the location of the radiation generating system ST and delay line L.

In the example sketched in FIG. 2, the cooling element K is arranged within the housing G of the linearizer. The circuit arrangement S is preferably secured with good thermal coupling on the cooling surface KL of the cooling element K serving as the carrier, for example via an adhesive coating with good thermal conductivity. The heat-emitting surface KH of the cooling element K abuts a surface of the linearizer housing G, which in turn abuts the inner side of the wall W. Good thermal coupling is again realized between the heat-emitting surface KH of the cooling element K, the abutting housing section of the linearizer housing G, the common wall W, and the heat-dissipating wall AF of the satellite. The considerations stated with respect to FIG. 1 are accordingly applicable to the operation of the arrangement and in particular to the operation of the cooling element K.

In addition to the sketched arrangements according to FIGS. 1 and 2, different variations are conceivable that combine details of the arrangements in different ways. In particular, an arrangement with a cooling element located within the housing G of the linearizer may be secured from the outside on the wall of a traveling-wave valve, or the cooling element may be arranged between an inside surface of a common wall W and a linearizer housing G located within the common wall. The positions for the arrangement of the linearizer housing G and the cooling element K in the embodiments described above have to be viewed as being only exemplified positions. The sketched exemplified embodiments are primarily designed under the aspect of descriptiveness of the figures. In particular, the linearizer housing can be secured also on a side surface or end surface of the wall W.

The invention is not limited to the preferred exemplified embodiments described above, but can be modified in some ways within the framework of the skills of the expert. In particular, a Peltier element may overall serve for stabilizing the temperature versus higher and lower temperatures and thus make it possible to constructionally combine in a valve arrangement temperature-sensitive components with other components with different permissible operating temperatures.

What is claimed is:

1. A traveling-wave valve arrangement comprising a traveling-wave valve and a linearizing circuit arrangement for compensating a phase response of said traveling-wave valve, wherein said linearizing circuit arrangement and said traveling-wave valve comprise one constructional unit and said linearizing circuit arrangement is maintained at a lower temperature than a wall of said traveling-wave valve by an active cooling element.

2. The arrangement according to claim 1, wherein said linearizing circuit arrangement is disposed in an electromagnetically screened housing, wherein said electromagnetically screened housing has an outer surface and an interior.

3. The arrangement according to claim 2, wherein said outer surface of said electromagnetically screened housing is cooled by said active cooling element.

4. The arrangement according to claim 2, wherein said active cooling element is disposed within the interior of said electromagnetically screened housing.

5. The arrangement according to claim 1, wherein said linearizing circuit arrangement is disposed proximate to a radiation-generating system of said traveling-wave valve.

6. The arrangement according to claim 1, wherein said active cooling element dissipates heat emitted by said linearizing circuit arrangement into said wall of said traveling-wave valve, or into a common wall of said traveling-wave valve and said linearizer when said linearizer and said traveling-wave valve are arranged within a common housing.

7. The arrangement according to claim 1, wherein the cooling capacity of said active cooling element can be controlled.

8. The arrangement according to claim 1, wherein the temperature of said linearizing circuit arrangement is maintained below 60° C. by said active cooling element.

9. The arrangement according to claim 1, wherein said active cooling element is a Peltier element.

* * * * *